United States Patent [19]

Landgraf

[11] Patent Number: 4,715,148

[45] Date of Patent: Dec. 29, 1987

[54] GEM FACETING MACHINE

[76] Inventor: Heinrich Landgraf, Waldherrstr. 17, D-8133 Feldafing, Fed. Rep. of Germany

[21] Appl. No.: 830,377

[22] Filed: Feb. 14, 1986

[30] Foreign Application Priority Data

Feb. 16, 1985 [DE] Fed. Rep. of Germany ..... 3505444

[51] Int. Cl.[4] ..... B24B 7/22

[52] U.S. Cl. ..... 51/229; 51/216 ND

[58] Field of Search ..... 51/229, 216 LP, 216 T, 51/216 P, 216 ND, 216 H, 217 P, 217 T, 237 T

[56] References Cited

U.S. PATENT DOCUMENTS

| | | | |
|---|---|---|---|
| 515,595 | 2/1894 | Linden | 51/229 |
| 1,575,156 | 3/1926 | Ecaubert | 51/229 |
| 3,466,813 | 9/1969 | Leibowitz | 51/229 |
| 3,811,229 | 5/1974 | Montgomery | 51/216 LP |

FOREIGN PATENT DOCUMENTS

| | | | |
|---|---|---|---|
| 1800614 | 11/1959 | Austria . | |
| 0111092 | 6/1900 | Fed. Rep. of Germany | 51/229 |
| 1752070 | 4/1971 | Fed. Rep. of Germany . | |
| 0555761 | 7/1923 | France | 51/229 |
| 0446099 | 3/1968 | Switzerland . | |

*Primary Examiner*—Frederick R. Schmidt
*Assistant Examiner*—Robert A. Rose
*Attorney, Agent, or Firm*—Ralf H. Siegemund

[57] ABSTRACT

A gem faceting machine has a main working spindle which can be pivoted in a vertical plane to obtain various inclinations of its axes, further being amenable to height adjustment and being capable of being rotated about its own axis, there being means for latching the rotational position of the spindle in particular positions as well as in positions in-between the particular positions, a multiple gem mounting structure includes a multiple chuck mounting element connected to the spindle for being turned therewith, and having a plurality of bores containing sleeves which in turn receive pin receiving spindles serving as rotatable chucks a rotatable and position arrestable actuating element and cover has a circle of latch bores and a central drive element coupled for rotation to the pin receiving spindles by means of gear pairs; an indexing pin holds the cover in one of the positions defined by the bores; and a plurality of gem mounting pins are directly or through an adapter element indirectly mounted to the spindles; for latching the main spindle one either uses existing latch equipment or integrates the same with the chuck mounting element.

11 Claims, 12 Drawing Figures

Fig. 7
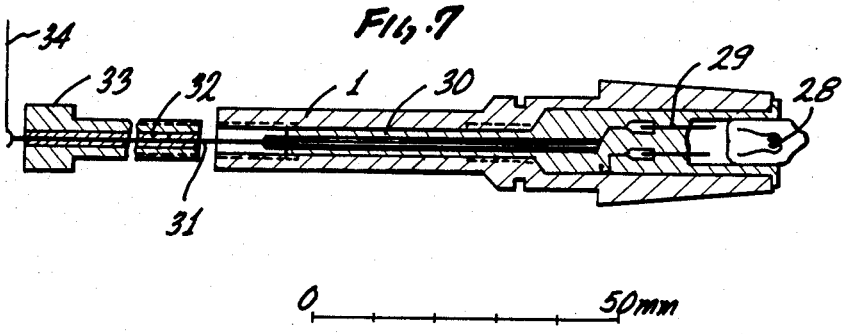
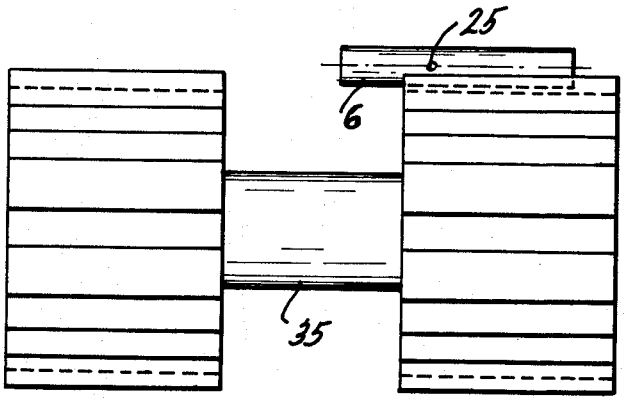
Fig. 8
Fig. 8a
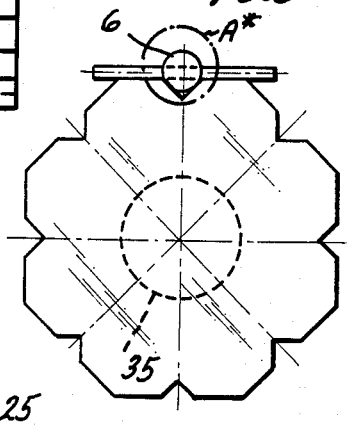
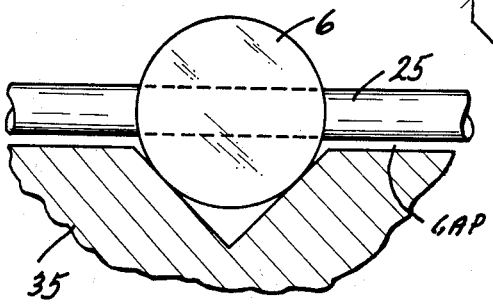
Fig. 9
DETAIL A*
0 10mm

GEM FACETING MACHINE

BACKGROUND OF THE INVENTION

The present invention relates to a faceting machine for beveling and otherwise cutting gems, precious and semiprecious stones and jewels, both, of the natural and the synthetic variety, but excludes diamonds. Herein the term faceting is to include the grinding, cutting, and polishing of all the facets and of the rond of such such stones, gem, jewels, etc.

The invention is particularly realized by expanding known facet machines, using a multiple jaw collet chuck, a supplemental adapting unit, and by being constructed for purposes of functionally expanding known gem faceting machines which can work on just one gem at the time, such machines are used by both professionals as well as amateures. The inventive gem faceting machine with multiple clamping and holding is expected to exceed the performance of known devices to a considerable extent particularly as far as realizable accuracy of working and functional expansion are concerned, but also with regard to versatility in cutting and grinding, geometry, and ease and comfort of operation, whereby these performance advantages are particularly obtained vis-a-vis single machines using merely mounting pins and driven grinding or cutting wheels or disks.

Moreover, the inventive machine is expected to exceed those which may realize a comparable accuracy in working and cutting, but which can process only one gem at the time. Automatically controlled machines which are provided for holding plural gem mounting pins, and being constructed primarily towards industrial mass production, however, are not comparable to faceting machines constructed in accordance with the invention.

The group or type of gem faceting machines being closely related to the type to which the invention pertains, in that particularly the invention can be regarded as a development and progress over these types of machines, require as a basic characteristic a very careful manual operation, such care being required throughout the entire working process. This manual operation involves particularly manual reciprocating the movable faceting unit across the cutting and grinding wheel or disk in the desired level, further included in these machines features permitting the adjustment of the angle of the respective facets. The working and cutting process progresses from facet to facet whereby the result is visually inspected frequently but is monitored intermittently requiring in each instance a folding up of the working spindle, which, of course, is mounted for rotation.

Aside from standardized or normal types of cuts, these machines should also be capable of cutting and grinding complex geometric patterns for purposes of enhencing brilliance and/or particular ornamental color effects. As far as mounting the gem mounting pins are concerned, these known machines, including those of the type which constitute the point of departure of the invention, have a single working spindle for clamping one mounting pin for a single gem to be bonded thereto. In order to obtain a particular facet pattern, all these machines use the same principle as far as positioning operations are concerned, in that they use wheels which are exchangeable and are either slotted, have gear teeth, or are provided with apertures for latching in well defined positions. This connecting or positioning structure is secured in each instance to the working spindle.

Typically, such a wheel or disk may have 56, 64, 72, 80, 96, or 120 teeth, and a latch is provided which engages any gap in-between any two teeth for arresting and latching the spindle in the particular position. In order to obtain other, i.e. intermediate positions in-between such positions, a nonius kind of fine adjustment is provided for moving the latch in tangential direction to the wheel.

Other known features to be employed are a fork-like support carrying the working spindle within a casing as well as the positioning and switching wheel, the fine adjustment device, and the latch. These elements are pivotable about a horizontal axis and adjustable as far as angular position is concerned between 0 and 90 degrees. This way one obtaines a particular facet angle. The basic arrangement of a working spindle with switching and positioning wheel mounted thereto, latch, and fine adjuster is shown in FIG. 6, as will be explained more fully below. These features are retained by the inventive device. Also, the adjustment of the vertical level, i.e. the positioning in the vertical, particularly in relation to the grinding and cutting wheel is usually effected in most instances by a carriage which can be shifted up and down on a vertical post and carries the entire faceting device. This has been omitted from FIG. 6 but is conventional mounting procedure. German printed patent application 29 34 796 provides for still a different kind of vertical adjustment.

In order to provide an easy indication of the adjusted facet angle which is a secondary angle in relation to the angular adjustment of the working spindle axis with and of the gem mounting axis in relation to the plane of grinding and polishing, a particular patented device has become known being traded under the trademark "H-82 Angleometer" and providing a digital indicating instrument which can be placed separately and independently from the machine for indicating the facet angle.

Another supplementary device has become known through the company Prismatic Instruments of Clayton, Wash., for supplementing known gem faceting machines, wherein a single mounting pin can be clamped in axis-parallel relationship at a selectable distance from the working spindle, and, therefore, eccentrically thereto. The purpose of this supplemental device is to permit cutting and grinding of curved surfaces, preferably at its rond. This pre-supposes that the working spindle, and all parts connected thereto, can be turned to a suitable angle as necessary for obtaining tear drop or shuttle-like peripheral contours.

For working the bottom of a gem or a table cut, requiring that the double pin as a perpendicular position to the grinding and/or cutting disk and plane of rotation thereof, one uses a single pin adapter which, in turn, holds the gem mounting pin at an angle of 45 degrees to the chuck. Such an adapter will thus be inserted into the chuck of the working spindle thereby replacing the regular mounting pin. An accurate perpendicular position of the gem mounting pin which is now placed into the adapter, will be caused with reference to a plane through a 45 degree grag inclination of the working spindle, and in a second position obtained through position of adjustment the positioning wheel as latched and under utilization of the correction provided by the fine adjustment. This permits a chatter-free working and cutting of the gem and ensures proper operation. For inspecting and monitoring the result of working, the entire device can be folded up.

After, either the upper or the underside of a gem has been completed, it is necessary to reposition the gem for working the respective other side very accurately and affix the gem to another mounting pin. Thus, any faceting machine is, in a general sense, associated with such a rebonding device. This device is matched to the particular mounting pin size. Such a re-bonding device is usually comprised of two aligned prisms in which the mounting pins are inserted and fastened. Thereafter, the gem will be bonded with a completed faceted side to a free mounting pin. Following curing of the adhesive, the first used pin on the opposite side is removed.

German printed patent application No. 17 52 070 describes a device for the concurrent facet making on several gems or jewels. By means of this known machine, a common angular adjustment vis-a-vis all gems to be worked on, is supposed to be made possible, particularly in relation to the working tool. This known device includes gem holders or mounting pins, being arranged along the peripheral of a drum and extending radially therefrom. Therefore, in this case, a concentric, i.e. axis parallel arrangement is not provided for. It is believed that this kind of an arrangement does not offer any significant advantage. Moreover, this machine is basically an automated device.

It should be mentioned that German petty patent No. 18 00 614 discloses a different gem faceting machine according to which several gems are cut simultaneously. The mounting pins in this case are arranged one next to the other in particular mounts but this particular publication is not believed to be of any relevance with regard of the approach taken as per the present invention.

The Swiss Pat. No. 446 099 describes an automated gem working machine with a revolver-head-like holder for the mounting pins being, therefore, capable of accommodating several such pins. This patent, however, is again related to an automated tool and differs as far as the present approach is concerned with regard to the objects to be worked on, and the overall construction and function. Moreover, the automated operation is tied to a rather rigid, i.e. inflexible, program and movement of the revolver-head-like mounting pin holder, so that it is believed that this publication is again rather remote from the approach taken in this application.

Various forms of gem and jewel faceting machines with eccentrical mounting as well as with rebonding structures are, by way of example, described and depicted in the following representative publications. Aside from the references already mentioned German printed patent application No. 29 34 796 has to be included as well as the following books:

Herbert Hartig, "Edelsteine und Mineralien selbst schleifen", Verlag Frech, Stuttgart 1967, pages 22–23, 26, 30–31;

Glenn Vargas, "Faceting for Amateurs", published by the authors, Glenn & Martha Vargas, 1969, Library of Congr ess, Catalog Card Number 70-87173, Chapter II, pages 16–24;

Karl Fischer, "Edelsteinbearbeitung", Volumn 1, RuehleDiebener-Verlag, Stuttgart 1985, pages 59–70.

The following papers and journal publications are of interest:

The Lapidary Journal, 3564 Kettner Blvd., P.O. Box 80937, San Diego, Calif. 92138;

April issue 84:
- page 52: Faceting unit; Model FAC-8, Imahashi
- page 61: American Facetor; ARG Sales Company
- page 78: H-82 Angleometer; Alpha Faceting Supply Inc.
- page 113: Gem-Master; Fac-Ette Manufact. Company
- page 129: Accura-Flex Model H-71A; Prismatic Instruments June issue 84:
- page 498: Ultra Tec August issue 84:
- page 685; Lee; Lee Lapidaries
- page 697: MDR; Master Faceting Instruments September issue 84:
- Inside Title page: Mark I, Mark Iv; Graves.

The state of the art, and particularly to the extent as it is related to gem faceting machines, for example, made by Prismatic Instruments and Lee Lapidaries, and others, are disadvantaged by the point that only one gem can be mounted, held, and worked at a time, which is not deemed to be an economical approach. In particular, interruptions and change in the object worked on, being necessary at all times for practical purposes, force the user to employ at least one additional machine, unless he can live with the downtime inherent in object removal and renewal. The removal forces the user to particularly mark the relativ positon of the mounting pin vis-a-vis its holder so that on return the disposition of that pin is exactly reproducable. Still, inaccuracies creep in and the process is time-consuming and cumbersome.

Moreover, certain facet geometries, particularly if they are not of rotational symmetry, cannot be adequately made under mere utilization of the known circle sub-dividing devices and methods, but the aforementioned fine adjustment is necessary to accommodate the non-symmetrical aspects. This, of course, means that upon returning the mounting pin one has to look for the respective facet so as to be able to resume exactly at the point of the interruption. No matter how many aids are used in adjusting, this process is very time-consuming.

Somewhat more sophisticated gem faceting machines attempt to avoid these drawbacks under utilization of mounting pins which have a latched position in the respective clamping structure. That, however, entails other drawbacks. For example, already on bonding the gem to such a pin, one has to anticipate the position of the pin in relation to the latching device after the insertion in the clamping structure. This anticipation is necessary in order to cause agreement and indexing of the reference points for the facet pattern in relation to the reference point on the switch and positioning wheel, and its latching position. also the reference point for the proper disposition of the gem has to be considered in the first place. If the peripheral shape of the gems have been prepared on a different machine or in a free-hand operation the subsequent faceting constitutes, so to speak, the fine finish. In this case, one has to expect deviation between the final facet geometry and the original, raw, peripheral shape. That, of course, entails numerous obvious drawbacks.

Another aspect of the known devices is that to the extent they are eccentrical devices, they exhibit have similar clamping and adjusting problems as described even though these eccentric devices permit cutting of facets which do not have rotational symmetry, the noted drawbacks are factors to be considered. Any accessories for the various gem and jewel faceting machines are closely tied to the particular principal machine for which they are accessories. This includes the rebonding device which, as stated, is comprised usually of two aligned prisms being interconnected. Such accessories also include the latching structure for clamping the mounting pins because these pins themselves are already tied to a particular machine. This means that the axial displacment of the mounting pins is quite limited and that, in turn, makes manipulation and handling more complicated. If one uses mounting pins without latch position then, of course, one again encounters known clamping and adjusting problems during manual intervention.

DESCRIPTION OF THE INVENTION

It is an object of the present invention to provide a new and improved gem and jewel faceting machine being constructed to overcome the drawbacks and problems outlined above and realizing the following aims.

Gems made of different materials, shape, and size and in any combination should be held, mounted and clamped, for being worked on; working of all held and mounted gems is to be sped up in that at least for some of them requiring similar cutting and working steps, such steps can be carried out in direct sequence gem for gem. This includes, for example, preliminary cutting of the main facets having similar facet angles; in the case one uses gems of similar shape but not necessarily similar size, they should be worked on in pairs.

However, during each working stage, working of an individual gem should optionally be carried out on an individual basis, particularly, for example, in order to accommodate two frequently occurring cutting situations. For example, if a sufficiently earlier made mistake is recognized, and has not progressed so that it can, if fact, be corrected, and therefor should be corrected, one should be able to provide such a correction even if this entails a deviation from the originally contemplated geometric pattern; examples here are braking off of pieces, inclusions, fissures, double cuts of facets and cracks from the grinding tool. In the case of precious stones and independently from the gem that is being held next to the particular one, a search type approach in cutting and grinding should be permitted such that the largest possible gem volumn can be retained and, therefore, the largest possible weight.

As far as different cutting operation is concerned, each mounting pin being in a working position should permit the following movements: a stepwise turning through predetermined angles for purposes of establishing the facet pattern. In addition a continuous rotating motion covering at least 360 degrees about the longitudinal axis should be provided for, particularly making cylindrical or conical round cutting patterns, and for finishing and shaping the ronde.

Moreover, a circular motion about the principle longitudinal axis of the respective main spindle should be permitted whereby upon turning the mounting pin axes delineate a cylindrical surface; this feature is provided for making a convex peripheral edge with relatively large radius of curvature as they are necessary for the so-called antique cut. Herein, the mounting pin should be able to undergo fine adjustment motions in two planes for correcting the disposition of the plane of cutting vis-a-vis the chosen cutting angle as well as the symmetry of the facets as a whole.

It is therefore a specific object of the present invention to provide a new and improved gem faceting machine which includes a carriage or the like being movable in the vertical direction, i.e. transversely to the plane of cutting, and carrying the entire facet cutting device the latter being arranged for pivoting about a vertical axis, so that with regular pivoting motion, carried out automatically or manually, the gem or gems being worked can be guided across the entire horizontal plane of cutting. Moreover, the device is to include a work spindle housing, being mounted for pivoting as a whole about a horizontal axis in-between stops, and including possibly an angle measuring and indication device as well as adjustable stops for covering any angle between 0 degree and 90 degrees as far as the desired facet angle is concerned; this housing is to be latched in particular position. The housing is to be provided for selective insertion gem mounting pins or an auxiliary tool for the eccentric mounting of such mounting pins or a 45 degree adapter. Moreover, the machine should permit use of conventional a fine positioning device for covering the range between two latch points.

It is a particular object of the present invention to provide a new and improved gem faceting machine having a main working spindle which can be pivoted in a vertical plane to various inclinations towards a horizontal plane of cutting and grinding, which, moreover, is amenable to height adjustment and can be rotated about its own axes. There being means for latching the rotational position of this main spindle in particular positions, as well as in positions in-between the particular positions.

In accordance with the preferred embodiment of the present invention, the object, and here particularly the specific and particular objects are attained by a gem mounting structure which includes a multiple chuck carrying element for connection to the main spindle for being turned therewith and held in the particular positons, as well as in the in-between positions, this chuck carrying element is provided with a plurality of bores receiving respectively spindles of a plurality, these spindles are rotatably mounted and held in the bores and are provided either for receiving directly gem mounting pins or an adapter to which, in turn, can be mounted gem mounting pins; a rotatable and position adjustable actuating element is provided and includes a drive element being coupled for rotation to the afore-mentioned pin receiving spindles. Moreover, means are provided on this actuating element for establishing a plurality of distinct latching and arresting positions cooperating with latching and arresting means which positively establish latched and arrested positions of the actuating element.

From a different point of view, the invention can be seen to be a combination of a plurality of features which include multiple clamping chuck element for at least two gem mounting pins which, as a whole, is fastened to a shaft which, in turn, is secured to the main working spindle of the gem and jewel faceting machine. There are to be at least two concentrically arranged (concentric vis-a-vis the main spindle) spindles with holdings and clamping structure for receiving these mounting pins. Moreover, the multiple chuck mounting and carrying structure is to be provided with an additional latching and arresting structure involving an operating element. A clamping shaft is provided for being connected to or integral with the multiple chuck mounting unit. Gears couple the actuating elements to the mounting pin spindles for turning from one mounting pin to the next one, one uses the wheel and latch as already provided, while by means of an also existing fine adjusting device, positions between two latch points while covered, while alternatively this latch structure is incorporated in the multiple chuck unit in addition to the arresting feature mentioned earlier. The gemmounting pins can be replaced by an adaptor having these pins mounted to it.

DESCRIPTION OF THE DRAWINGS

While the specification concludes with claims, particularly pointing out and distinctly claiming the subject matter which is regarded as the invention, it is believed that the invention, the objects and features of the invention, and further objects, features, and advantages thereof will be better understood from the following description taken in connection with the accompanying drawings, in which:

FIG. 7 is a longitudinal view through the central axis such as in FIG. 3 but supplemented by an illumination device;

FIGS. 8 and 8*a* are respectively side and front view of a rebonding device with inserted mounting pin and a targeting rod;

FIG. 9 is a detail of the front view of FIG. 8*a;* and

Figure 1:
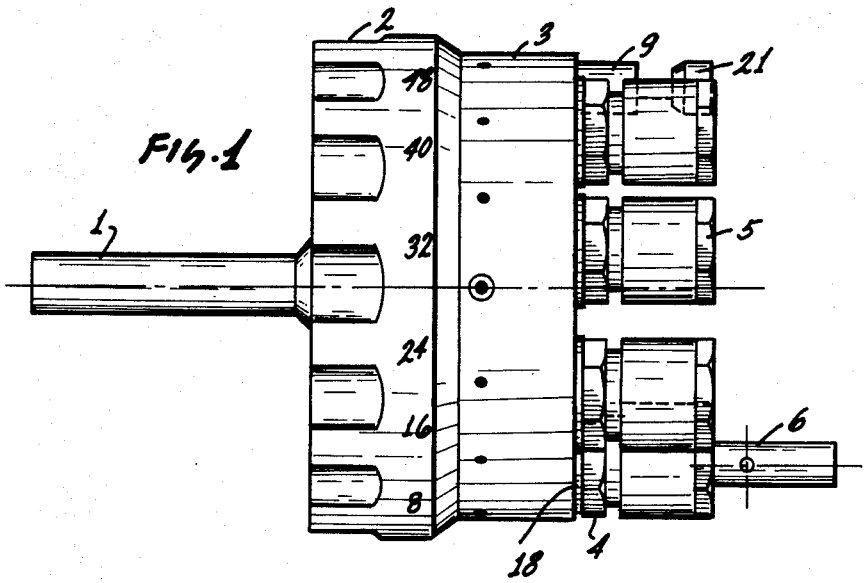
FIG. 1 is a side view of a multiple chuck mounting and clamping structure, in accordance with the preferred embodiment of the present invention for practicing the best mode thereof accommodating in this instance seven mounting pins, and having, therefore, seven spindles.

Proceeding now to the detailed description of the drawing, the figures show an example for practicing the best mode of the invention, whereby particularly the elements constituting the basic feature of the invention, are arranged in relation to the central axis or shaft 1. One side of this shaft 1 is configured as clamping pin with tightening thread while the opposite side tapers in the form of a slim cone 1*a*. A casing or turret 3, the main chuck mounting and carrying element; it is provided with a matching conical central bore 3*a* and has been force-fitted onto the conical portion of the shaft 1. The cylindrical central portion 1*b* of the shaft 1 is fine finished, particularly between the side of the casing and a shoulder 1*c* leading to the clamping pin 1*d*. The fine finish may well have involved cutting and polishing.

The central cylindrical shaft part 1*b* serves as a bearing for a drive wheel 17 which has been placed from the pin side onto the shaft 1. A suitable bore is provided in the wheel 17 and configured as a friction sliding bearing. Moreover, a spreadable clamping ring 13 is seated in an annular groove in the shaft portion 1*b* axially secures the position of the wheel 17 vis-a-vis the shaft 1.

Figure 3:
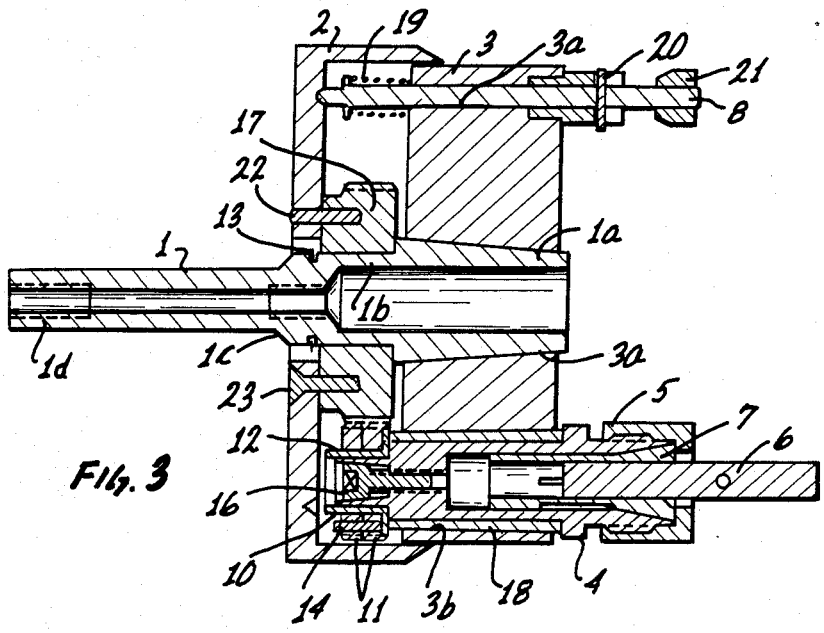
FIG. 3 is a longitudinal view indicated by the plane A—A in FIG. 2.
Figure 3A:
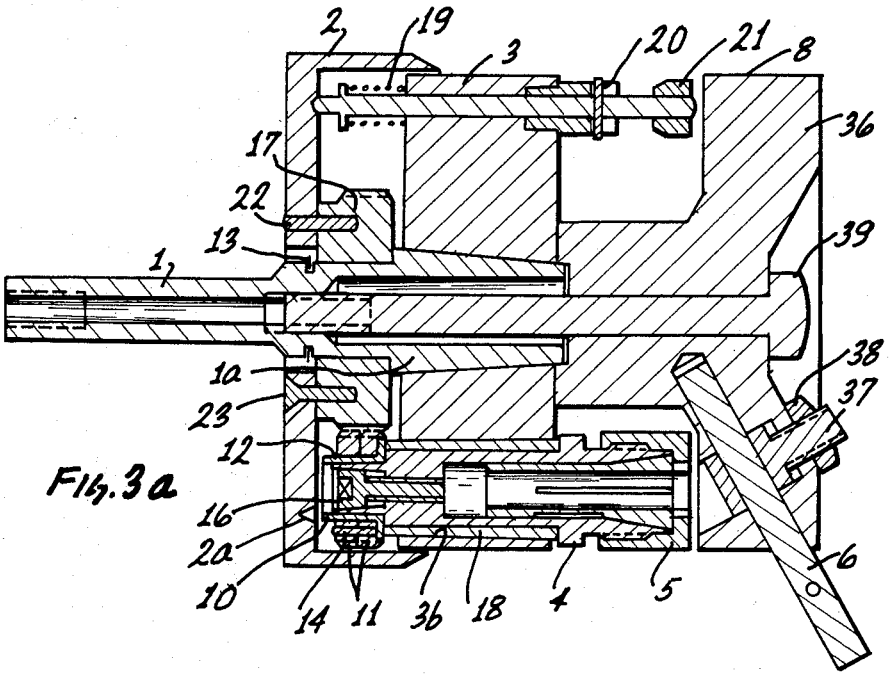
FIG. 3*a* is a longitudinal view similar to FIG. 3 but including in addition a mounted, multiple adapter, while details are shown only with regards to one mounting pin.
Figure 4:
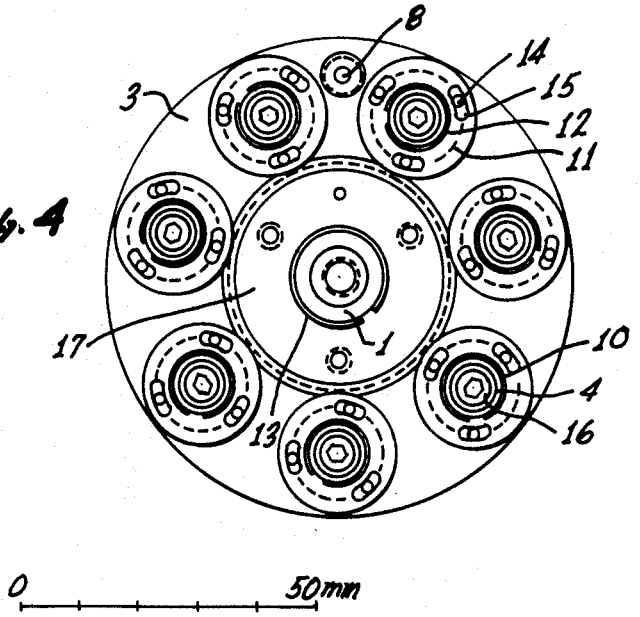
FIG. 4 is a rear view of the device shown in FIG. 1, with removed cover.

Before mounting in the stated fashion takes place the drive wheel 17 has received an indexing pin 22 through force-fitting an indexing pin 22 there being an appropriate bore provided in cover 2 for that purpose. Also, a lubrication duct has been worked into the bearing bore. Any play that may remain particularly as far as the axial position is concerned, and involving particularly the wheel 17, is to be corrected through accurately cut, compensating disks, shims, or disk-like shims. In order to reduce the weight of the equipment, and furthermore for receiving an illumination device, such as device 28, 29, 30, and 34 (FIG. 7), or for receiving a multiple element adapter 36 (FIG. 3*a*), the shaft 1 is basically made of a hollow configuration. Finally, the clamping pin 1*d* is provided with two tightening threads.

The casing or turret and chuck mount 3 is provided with seven conical bores 3*b* arranged concentrically i.e. with the same radial distance from the axis of shaft 1, being also the center axis of bore 3*a* in turret 3. Bores 3*b* receive seven bearing sleeves or bushings such as 18, each of eccentric configuration, and being preferably being made through sintering to obtain particularly trouble-free and maintenance free sleeves. The sleeves 18 are configured conically on the outside and have been forced into the respective bores 3*b* and turret 3. Each individual sleeve 18 has previously being provided, i.e. fitted, with a spindle 4 which has also fine finish with extreme accuracy. These spindles will receive the gem mounting pins 6, and are thus to be construed as chuck elements.

A pair of gears 11 is provided for meshing gear wheel 17. By trial and error adjustment (turning) of the respective sleeves 18 slack in the gears is minimized; this particular position has been marked. Any residual play between the sleeves 18 and the spindle 4 must be removed either through subsequent finishing or by means of compensating disks or both. The spindles 4 are designed for extreme accurate concentricity (roundness) on the side receiving clamping devices so that a pressure clamping device can be used as they are available in the trade. The spindles are provided on the outside with a threading for receiving a nut 5 and a hex-nut head for permitting angangement by a wrench. The rear end of each spindle 4 ends in a multiple slotted spreading sleeve by means of which the completely mounted gear pair 11 can be clamped under utilization of spreading screw 16.

A sleeve 10 is provided with a flange for carrying the gear pair 11. This sleeve 10 is forced into one of the gears such that the flange will be received in a cut-out of that particular gear and is flush therewith. The sleeve 10, i.e. the part thereof projecting from the gear serves as bearing seat for the second gear of pair 11 which is mounted for easy rotation on the sleeve 10. This second gear is axially secured by means of a spreading ring 12, otherwise being seated in an appropriate groove in the sleeve 10.

The two gears of the pair 11 and the pair as such is coupled through three steel pins 14. The pins are arranged concentrically in and around one of the gears and forced into position therein, while the respective projecting ends reach in appropriately configured longitudinal slots of the second gear, so that (in principle) the two gears can move in relation to each other with ease. After both gears have been turned in a particular manner to obtain the desired position, the oblong slots receive a suitable elastic material which following curing becomes an elastic or resilient body 15. Now such a gear pair 11 is ready for assembly into the unit as a whole.

The mounting pin spindles 4 will be introduced next into the respective associated bearing sleeve 18, the gear pair 11 is pretensioned by the spreading portion of the respective mounting spindle and are shifted thereon and clamped by means of the screw 16.

A cross-wise slotted sleeve 9 for an indexing and latching pin 8 is forced into an appropriately prepared bore 3c in turret 3 and is finished so that the indexing pin 8 will slide with ease in the sleeve 9 but without any play. The slots in sleeve 9 have different depth and serve as a guide for a transverse guide pin 20 which is transversely force-fitted into the indexing pin 8. The cross slots are configured such that in one position the tip or peak of the indexing pin 8 will be inserted in one of the bores 2a arranged in a circle inside housing cover 2, so that the cover 2 will be held (latched and arrested) without play in the respective position relative to turret 3. These bores 2a have a conical configuration with an apex angle of 60 degrees, being the same as the conical tip angle of pin 8.

In the second position, requiring the indexing pin 8 to be rectracted against the resistance of a coil spring 19, and following a 90 degree rotation of pin 8, pin 20 is inserted in the second pair of slots in the cross-slot, being less deep so that pin 8 clears all openings 2a; free turning of the housing cover 2 is now ensured. The dimensioning of the 60 degree bores in cover 2, the length of the path of working of spring 19, the depth of the cross slots, as well as the disposition of the transverse bore in the indexing pin 8, all must be adjusted for flawless latching as well as unlatching functions, and therefore, they must be attuned to each other to the greatest possible accuracy. Operation of this latching device is carried out by means of the head or knob 21 which has been threaded on top of the indexing pin 8.

On the inside cover 2 carries (but being integral therewith) the circle of bores or apertures 2a, there being altogether 64 such bores or indentations each having a 60 degree profile. They are radially aligned with engraved scale lines 2b. The radius of the circle delineated by apertures 2a is equal to the center to center distance between the shaft 1 and the indexing pin 8. The circle is divided into 64 parts. The bores 3a are thus 360/64 degrees apart on account of the transmission ratio of the gears, following special features obtained. The first bore at the 0–360 degree point corresponds to the mounting pin 0–64 analogously the following table develops.

| Bore | Angle | Mounting Pin |
|---|---|---|
| 2 | 5.625 degrees | 2 |
| 3 | 11.250 degrees | 4 |
| 31 | 174.375 degrees | 62 |
| 32 | 182.812 degrees | 1 |
| 33 | 188.437 degrees | 3 |
| 62 | 35.562 degrees | 61 |

-continued

| Bore | Angle | Mounting Pin |
|---|---|---|
| 63 | 35.187 degrees | 63 |

Herein, the last column constitutes the so-called index numbers wich, as far as cutting programs are concerned, are angle positions identified by such numbers.

In order to complete the assemblies of the device as per the invention, cover 2 is shifted unto the indexing pin 22 of drive gear 17 and bolted by means of screws 23 for purposes of completion; it is now ready for operation.

A multiple adapter 36 is provided in addition, having seven bores for receiving gem mounting pins at an inclination of 60 degrees in relation to the center axis of shaft 1. The mounting pins 6 can be inserted into the adapter and they will be held, i.e. clamped, by means of clamping bolts 37. This then constitutes an indirect mounting of the pins 6 to the spindles 4. The bolts 37 each have a transverse bore corresponding to the pin diameter, and they are also provided with a step and a threaded pin portion. The clamping bolts 37 are slidable held and guided in blind bores and they can be tightened by means of nuts 38 after the respective pins 6 have been inserted in the adapter.

Figure 10:
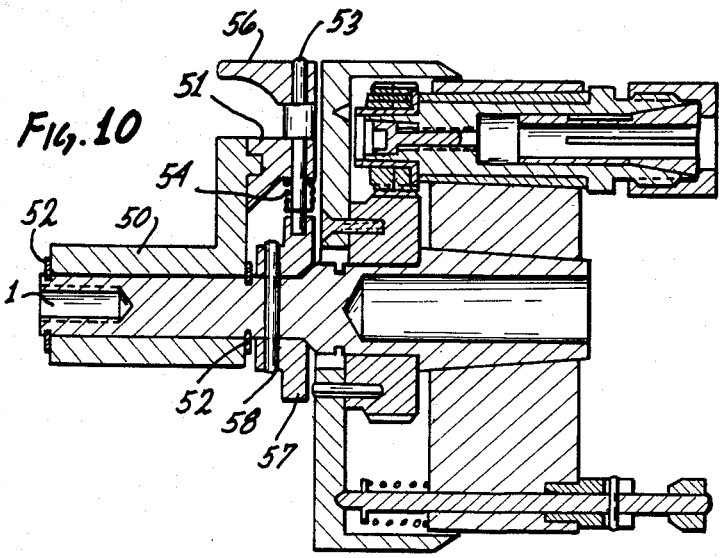
FIG. 10 is a view similar to FIG. 3, but showing a modification concerning main spindle latching.

The embodiment shown in FIG. 10 uses the same spindle and gem mounting pin arrangement (chuck) as being mounted in a turret 3 and cooperating with a cover 2 to which is mounted a drive wheel 27. However, the embodiment deviates from the one previously described by a modification of latching in fine positions in that these devices are shown in FIG. 10 to be integrated in the plural chuck turret structure 3. The shaft 1 is provided as before, but it is rotatably seated in a clamping sleeve 50 which is configured, on one hand, with a carrier flange on which a slide piece 51 is mounted. The clamping sleeve is secured to the shaft 1 by means of the two spreading rings 52. The slide piece 51 may be provided for adjustment in peripheral direction, i.e. about the axis of shaft 1 and by means of a very fine working spindle drive (not shown). This slide element 51, particularly its adjustability in peripheral direction, constitutes the fine position adjustment device. Slide piece 51 carries a latch or stop pin 53 being biased by means of a spring 54, there being in addition a latching and locking pin 55 as well as an operating knob 56. The latching pin 53, when in latching position, enters a bore in a wheel 57. This wheel 57 is the positioning wheel, and, is fastened to the shaft 1 by means of an indexing pin 58. This means that the device 3 with all appended parts is rendered independent from any latching structure that may be present (or not) on the principal spindle 39 to which the turret is connected.

It can thus be seen that the invention as described by way of the foregoing example uses normally plural receivers, namely the spindles 4, for mounting the gem mounting pins 6. This arrangement in the turret 3 follows the so-called revolver principle. Depending upon the dimensions, there is no limit in principle to the number of chuck defining spindles 4 that can be accommodated. In practice, of course, the dimensions of basically known faceting machines in conjunction with the usually employed cutting and grinding disks, establish certain limitations, and here up to about ten spindles 4 are a realistic aspect of practicing the invention. To employ just two spindles is marginal as far as economy is concerned, while an excess of ten spindles 4 would amount to a compromise with regard to maneuverability of the faceting device as well as an undue high weight.

Figure 6:
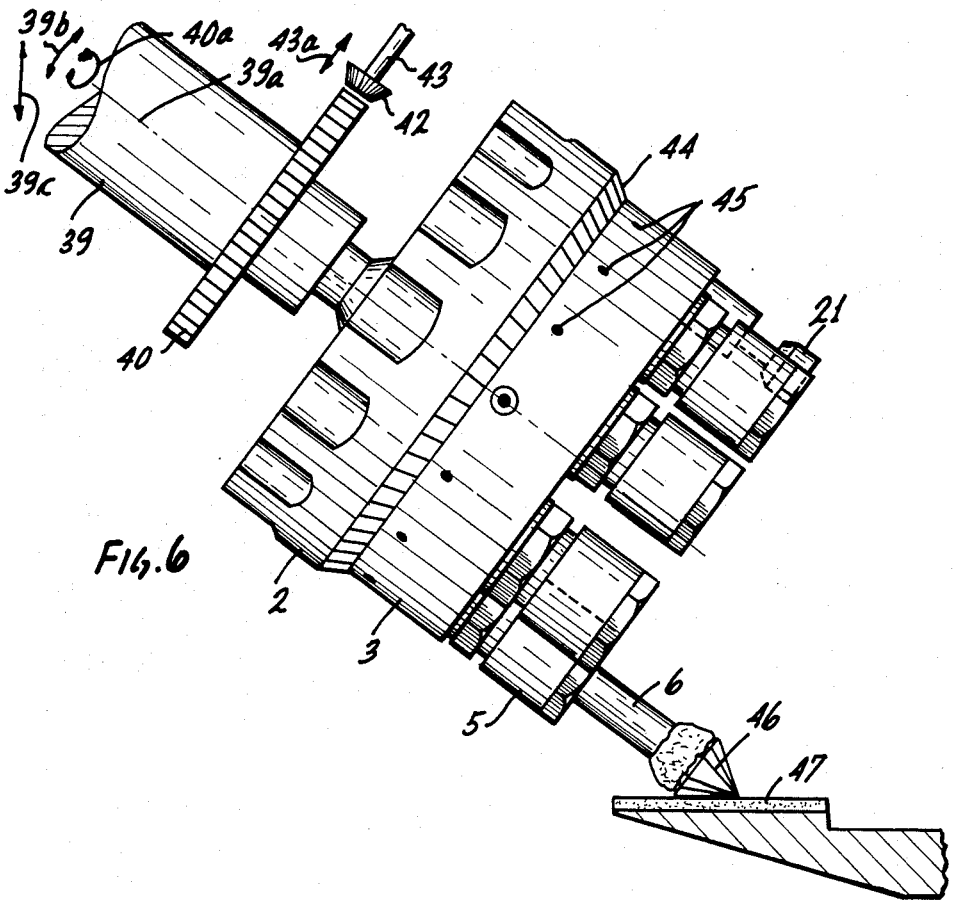
FIG. 6 is a side view corresponding to FIG. 1 and showing, for purposes of completion, the working position of a mounting pin with a gem mounted thereon, also a portion of a cutting and grinding disk, the working spindle and a gear, latch are shown.

The so-called turret and revolving principle employed relates specifically to placing one gem mounting pin and the respective spindle after the other in the range of working, whereby the known principle of basic positioning is retained. FIG. 6 shows one pin 6 with gem 46 bounded thereto in working relation to a cutting or grinding disc 47. The positioning aspects are also shown in FIG. 6, there being the main mounting and working spindle 39 which is movable up and down (double arrow 39*c*) and pivotable about a horizontal axes such that its axis 39*a* can pivot up or down (double arrow 39*b*), i.e. change inclination in a vertical plane. This main spindle 39 carries a gear or latch wheel 40 cooperating with a latch structure 43 with a latch element 42, being movable as indicated by the double arrow 43*a*, so as to adjust the azimuthal disposition of the turret housing 3 in various positions. In addition, this device 43 can be moved in the plane delineated by the gear wheel 40 to permit in-between positions of latching. In view of these aspects and in order to obtain the requisite function the wheel 40 must have as many teeth, i.e. latch positions as needed. For the given number of spindles 4 (being seven in this case), the number of latch wheel positions is an integral multiple of the number of spindles 4. In this case it is assumed that 56 latch positions for the latched wheel 40 obtain.

Another aspect is that the casing or turret 3 should be provided on the outside with markings in the form of the above-mentioned index numbers, particularly for denoting the mostly used steps and in 64 steps for purposes of facet making. It is within the purview of the invention to provide more than one aperture circles inside the casing cover 2. A transmission gear being provided by the gear pair 11 provides a gear ratio of 1:2. In this case then, one uses the fact that after half a turn of wheel 17 (and cover 2) a complete revolution of any of the spindles 4 is obtained. This means, from the point of view of construction, that the number of dividing steps, namely 56, 64, 72, 80, 96, and 120, can, in fact, be accomodated by a 180 degree arc. Otherwise this would provide rather tight conditions for the mentioned various components. However, the principle is translated into a particular construction, namely to divide a first semi-circle for even number steps to be used during the first turning, and an odd number of steps to be placed into the second semi-circle, being associated with the second revolution of the mounting spindles 4. Here then one obtains the advantage that, as far as manufacturing the circle partioning is concerned, one has 360 degree available rather than 180 degree which, in turn, means that one has twice as much space for bores and gears and slots as with otherwise present.

Figure 2:
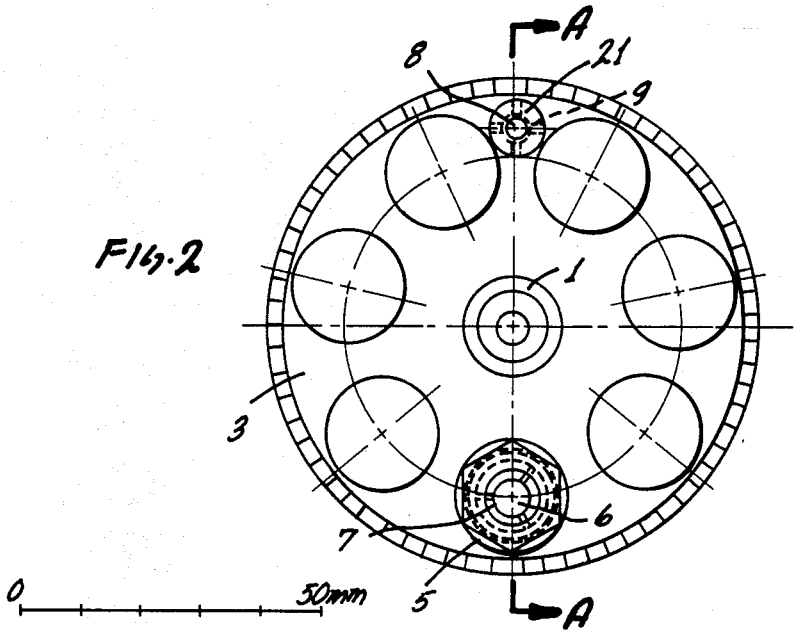
FIG. 2 is a front view of the device shown in FIG. 1, but only one of the spindles is shown in detail.
Figure 5:
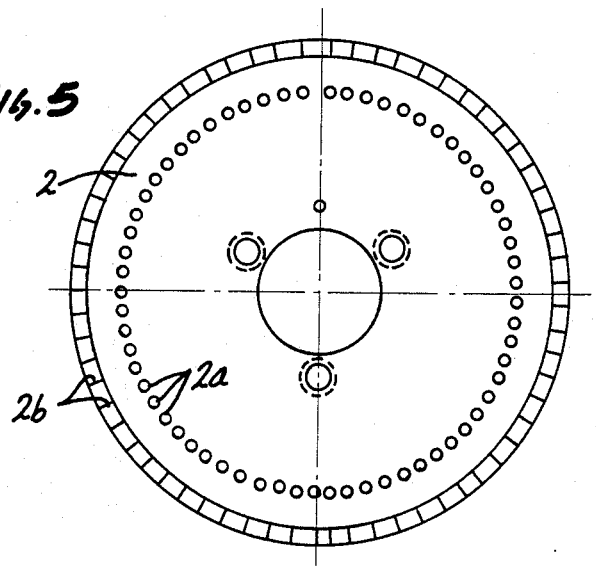
FIG. 5 is a top elevation of the inside of the removed housing cover.

FIG. 5 illustrates specifically the cover 2 with 64 steps and circle partioning on account of 64 bores 2*a* as chosen. It should be denoted that the cover 5 could be provided in addition with the multiple blind bores in order to save weight. The cover 2 (being the main actuating element) is shown articularly in FIG. 2 with gripping indentations for ease of turning but one could, instead, insert pin-like handles which would be an advantages feature for purposes of round cutting.

The principal operating element of the turret is thus cover 2 which may, in addition, cooperate with an electronic device for counting partial steps to permit reading of the index position of the respective spindles 4 on a separate instrument. This offers the advantage of an easy and simple indication of the working position of the turret, without, however, being encumbered by the position of the turret itself.

The adapter 36 (FIG. 3*a*) is disposed to abut centrally the front end of turret 3, and is, in fact, centered by means of the shaft 1. A particular screw 39 is provided for tightening the adapter to the turret.

The device in accordance with the invention, moreover, is prepared for receiving an illuminating device shown in FIG. 7, and being specifically provided for insertion into the hollow shaft 1. This illuminating device will be used particularly whenever the adapter 36 is not used, and is prepared such that the gems as bonded to the respective mounting pins 6, will appear within the cone of light. The illumination, of course, propagates with any movement and, therefore, permits clear and unencumbered observation of the faceting process. Moreover, this illuminating device facilitates careful and gentle placement vis-a-vis the grinding or polishing disk. In this case then a light gap control is possible which is also used for the rebonding structure (holder 35).

Included within the illustrated concept and as an advantageous embodiment for practicing the invention, it should be mentioned that the illumination should be turned on or off by means of a position adjustable and inclination depending switch, which, for example, is fastened to the basic horizontal shaft (not shown) for mounting the machine, and will be turned on only when the gem 46 is just a few millimeters above the grinding disk 47. The illumination device as shown in FIG. 7 is, in fact, integrated with the central axes.

The invention does not necessarily use, but it is of advantage to provide the pins 6 with a small transverse bore for being traversed by a viewing rod 25 as shown in FIG. 9. This rod 25 is inserted without play in the bore of pin 6, and by means of this rod 25 one can visually or through measurement in relation to the adjoining spindles 4 orient the particular mounting pin 6 in relation to the plane of cutting and grinding. The rod 25 as introduced permits either visual or instrumentation measuring of the distance to the adjacent mounting pins, or in case of a horizontal adjusted turret, one can measure in relation to the plane of grinding and cutting.

In cases, the pin 6 to be adjusted may have to be turned in its receiving spindle 4, for open clamping device 7 (nut 5 off) to obtain a correction until to the left and to the right (FIG. 9) the same distance of rod 25 from 35 obtains. This particular adjustment will always be reproducable very accurately. The reproduceability between the multiple mounting turret 3 on one end and the rebonding on the other hand, must be mutual because for the rebonding device (holder 35) particularly prism heights are chosen, being adjusted to that particular measurement, and the same measuring principle, namely the parallel orienting of the rod 25 to the base of the prism, preferably after a light gap observation, should be used again. All these aspects are, in fact, realized by the structure shown in FIGS. 8, 8*a*, and 9 for seven pins and mounting spindles 4.

The mounting device generally as per the invention permits gem and jewel faceting under utilization of different working motions which can be carried out individually or in combination to obtain different results. Round cuts will be obtained by turning the cover 2 for a latched spindle 39 and 1, under the observation that the pin receiving spindles 4 are not latched in any position. The cuts of particular facets, on the other hand obtain through stepwise moving the spindles 4, followed by latching and under consideration that the main spindle 39-1 is likewise latched, which is followed by switching from one spindle 4 to the next one under utilization of the latching device 40 and 42. Non-circular cuts can be obtained through combined and sequentially carried out partial turning of the entire turret 3 around the axis of spindle 39 after respective turning and switching from one spindle 4 to the next one. Certain other cuts with vertically oriented mounting pins 6 require the interposition of the adapter 36 as shown.

The invention is not limited to the embodiments described above, but all changes and modifications thereof, not constituting departures from the spirit and scope of the invention, are intended to be included.

I claim:

1. In a gem faceting machine having a main working spindle which can be pivoted in a vertical plane to obtain various inclinations of its axes, further being amenable to height adjustment and being capable of being rotated about its own axis, there being means for latching the rotational position of the spindle in particular positions as well as in positions in-between the particular positions, a multiple gem mounting structure comprising:

a multiple chuck mounting element provided for connection to said spindle for being turned therewith, the element having a plurality of receiving bores the bores being concentrically arranged on a common circle;

a plurality of pin receiving spindles serving as chucks and respectively rotatably mounted in said bores of said multiple chuck element and being thereby radically equidistantly arranged therein;

a rotatable and position arrestable actuating element including a drive element coupled for rotation to said pin receiving spindles;

means on said actuating element for establishing a plurality of distinct latch and arresting positions;

latch and arresting means cooperating with the means for establishing, for arresting the actuating element in any of its positions;

an adaptor element for selective mounting to the chuck mounting element; and a plurality of gem mounting pins being directly without use of the adaptor element or through an adapter element indirectly mounted to the spindles of the plurality.

2. In a gem faceting machine, the gem mounting structure as in claim 1, said element being provided with bores, there being sleeves mounted in said bores, said spindles of the plurality being mounted in said sleeves.

3. In a gem faceting machine, the gem mounting structure as in claim 1, said spindles being provided with means for clamping, for receiving different mounting pins.

4. In a gem faceting machine, the gem mounting structure as in claim 3, said spindles provided as slotted spreading sleeve at their respective end, opposite the end provided with means for clamping, there being gears releasably fastened by means of bolts to said slotted spreading sleeve, said gears engaging said drive element.

5. In a gem faceting machine, the gem mounting structure as in claim 4, wherein said gears are arranged in pairs are tensioned in relation to each other by elastic means, there being a plurality of such elastic means per gear pair.

6. In a gem faceting machine, the gem mounting structure as in claim 4, said spindles being adjusted to retain play free the position exercising a particular holding moment.

7. In a gem faceting machine, the gem mounting structure as in claim 1, wherein said actuating element is a drum-shaped housing cover on said chuck mounting element and carrying a circle of bores, the bores being the means for establishing distinct latch positions.

8. In a gem faceting machine, the gem mounting structure as in claim 1, said mounting pins each being provided with a transverse bore for temporarily receiving a targeting rod.

9. In a gem faceting machine, the gem mounting structure as in claim 1, said adapter provided for receiving mounting pins in a star-like pattern.

10. In a gem faceting machine, the gem mounting structure as in claim 1, including illuminating means mounted to said shaft.

11. In a gem faceting machine, the gem mounting structure as in claim 7, said cover provided with gripping means for obtaining easy turning.

* * * * *